US006171745B1

(12) United States Patent
Ohno et al.

(10) Patent No.: US 6,171,745 B1
(45) Date of Patent: Jan. 9, 2001

(54) TONER FOR TONER-JETTING

(75) Inventors: Yasuhiro Ohno; Ken Tanino, both of Ibaraki; Toshiya Natsuhara, Takarazuka; Masahiro Anno, Sakai, all of (JP)

(73) Assignee: Minolta Co., Ltd., Osaka (JP)

( * ) Notice: Under 35 U.S.C. 154(b), the term of this patent shall be extended for 0 days.

(21) Appl. No.: 09/551,562

(22) Filed: Apr. 18, 2000

(30) Foreign Application Priority Data

Apr. 27, 1999 (JP) ..... 11-119696

(51) Int. Cl.[7] ..... G03G 9/08
(52) U.S. Cl. ..... 430/111
(58) Field of Search ..... 430/111

(56) References Cited

U.S. PATENT DOCUMENTS

| | | | | |
|---|---|---|---|---|
| 4,987,454 | | 1/1991 | Natsuhara et al. | 399/280 |
| 5,240,803 | | 8/1993 | Ota | 430/106 |
| 5,477,250 | | 12/1995 | Larson | 347/55 |
| 5,759,731 | | 6/1998 | Hagi et al. | 430/106.6 |
| 6,077,635 | * | 6/2000 | Okado et al. | 430/111 |

* cited by examiner

*Primary Examiner*—Roland Martin
(74) *Attorney, Agent, or Firm*—Burns, Doane, Swecker & Mathis, LLP

(57) ABSTRACT

The present invention related to a toner used in a toner-jetting system wherein the toner is jettingly adhered to a recording medium in a direct manner, the toner having a specific angle of repose, a specific mean roundness and/or a specific distribution of a particle size.

20 Claims, 6 Drawing Sheets

TONER FOR TONER-JETTING

This application is based on application No. Hei 11-119696 filed in Japan, the contents of which are hereby incorporated by reference.

BACKGROUND OF THE INVENTION

1. Field of the Invention

The present invention relates to a toner for toner-jetting used in a toner-jet system, wherein the toner from a toner-supporting member is jettingly adhered to a recording medium, such as a paper and the like in a direct manner to form an image while said toner-supporting member and recording medium are maintained in a noncontact state.

2. Description of the Related Art

As an apparatus for copying (printing) images, such as characters, figures and the like, an electrophotographic apparatus has generally been used heretofore. However, there are problems that a size of said apparatus grows larger and a manufacturing cost of said apparatus increases because in said apparatus, a latent image is formed on a surface of an image-supporting member (a photosensitive member), and a formation (development) of the image is carried out by adhering a toner to the latent image formed on the supporting member in order to make the latent image visible, and then the toner image obtained on the supporting member is transferred to the recording medium.

Therefore, a toner-jetting system (a direct recording method) has been proposed, in which a recording medium, such as a paper and the like is conveyed between a recording electrode and a back electrode that are arranged on the opposite side of a toner-supporting member, and a toner is electrostatically charged by impressing a voltage corresponding to an image signal between the recording electrode and the back electrode, and then the toner from the toner-supporting member is jettingly adhered to the recording medium in a direct manner according to a state of the impressed voltage.

However, in such a toner-jetting system wherein the toner passes through manyl holes of the recording electrode at the time of flight of the toner from the toner-supporting member to the recording member, the problem has been arisen that the toner adheres to the recording electrode to clog up the manyl holes of the recording electrode when the toner makes a flight from the toner-supporting member to the recording member.

Besides, such a recording method brings about a problem that an image noise occurs when an electrification amount of the toner is changed by a change of circumstance as well as a change of the toner with the passage of time. For example, said recording method poses the problems that a phenomenon wherein dots are stretched and distorted toward a moving direction of the paper (a trailing or tailing) takes place in case of printing dots, and that a phenomenon wherein the toner particles are scattered between the lines on a texture region of the paper caused by an impact force at the time of impacting the toner particles on the paper as well as a repulsion force between the toner particles (a scattering) occurs in case of printing lines. Moreover, there are a problems that an image density decreases as it is difficult to smoothly adhere the toner on the recording medium and that even if the toner could be adhered on the recording medium, a sharpness of the image decreases as a boundary between the toner region and the texture region of the paper gets broad (obscure) and the boundary cannot clearly be recognized.

Additionally, there is a problem that the above-mentioned problems become more seriously when an electrification amount of the toner is relatively high because the apparatus using the toner-jetting system mentioned above shows a marked tendency that an optimum electrification amount of the toner is changed depending on a setting condition of the apparatus.

SUMMARY OF THE INVENTION

The present invention has been worked in view of the aforementioned circumstances. The object of the present invention is to provide a toner for toner-jetting having a broad allowable range of the electrification amount as well as an excellent image quality, which does not bring about the clogging, the trailing, the scattering, the decreases of the sharpness and density of the image and the like even if the electrification amount of the toner is changed to some extent by a change of circumstances as well as a change of the toner with the passage of time.

The present invention related to a toner used in a toner-jetting system wherein the toner is jettingly adhered to a recording medium in a direct manner, the toner having a specific angle of repose, a specific mean roundness and/or a specific distribution of a particle size.

DETAILED DESCRIPTION OF THE PREFERRED EMBODIMENTS

Figure 1:
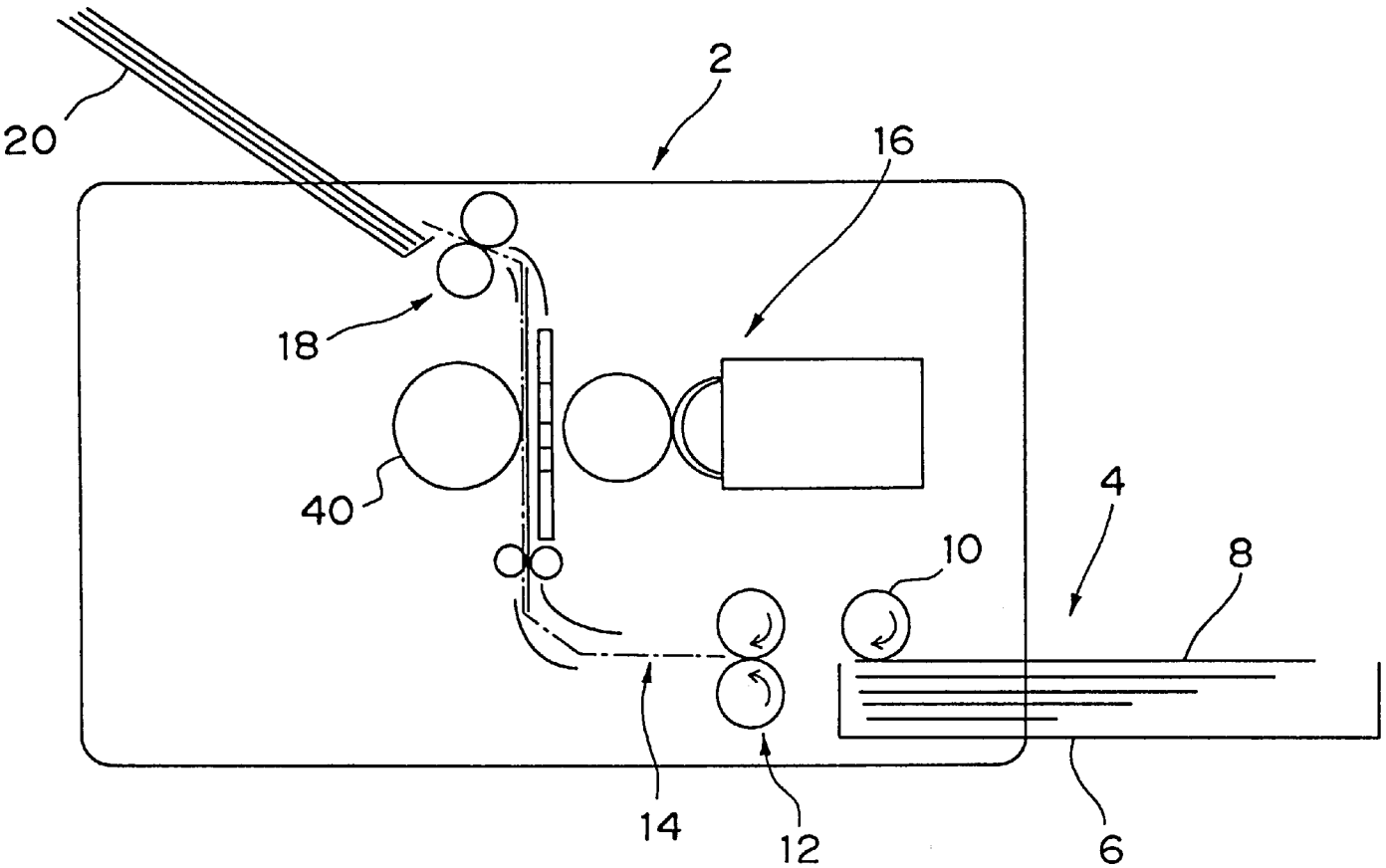
FIG. 1 is a schematic constructional view of an example of an image-forming apparatus (direct printing apparatus) to which the toner of the present invention can be applied.

The first invention relates to a toner for an image-forming apparatus using a toner-jetting system wherein the toner is jettingly adhered to a recording medium in a direct manner, the toner having a repose angle of 8.0–34.0° and a mean roundness of 0.945–0.992.

The second invention relates to a toner for an image-forming apparatus using a toner-jetting system wherein the toner is jettingly adhered to a recording medium in a direct manner, the toner having a repose angle of 3.0–34.0° and a mean roundness of 0.945–0.992 and that a content of a toner whose particle size is 9 $\mu$m or more is 23% by weight or less.

In the toner of the first invention, the repose angle is 8.0–34.0°, preferably 10.0–33.0°, more preferably 11.0–29.0°, and the mean roundness is 0.945–0.992, preferably 0.961–0.981, more preferably 0.964–0.971.

If the repose angle exceeds 34.0°, an image density is remarkably reduced and the tolerance range for the setting condition of the apparatus becomes remarkably narrow when the electrification amount of the toner is set to a slightly higher value. In general, a toner having a relatively high electrification amount requires a relatively high applied voltage at the time of flying from the toner-supporting member to a recording medium. It is thinkable that the toner having the abovementioned high repose angle becomes difficult to fly and the image density is remarkably reduced when the electrification amount is slightly increased under the constant applied voltage because said toner requires higher applied voltage. If the repose angle is less than 8.0°, there is a tendency that the holes of the recording electrode through which the toner passes are clogged in a relatively earlier stage and the image density is reduced at a relatively low electrification amount when the printing is repeatedly carried out. Further, if the repose angle is too low, the scattering of the toner occurs, and the sharpness of the toner is reduced when the toner has a relatively higher electrification amount. It is thinkable that the clogging is easy to occur because the toner having a low repose angle rapidly enters into the holes of the recording electrode in a state where the toner particles are closely contacted with each other without forming a space between the particles. Further, it is thinkable that the image density is reduced at a relatively low electrification amount because an opening area of the holes is reduced by the influence of the clogging and the flying toner becomes difficult to pass through the holes. Furthermore, the toner having a relatively high electrification amount is easy to accelerate under the influence of an electrical field, and said toner comes into collision with the recording medium in an accelerated state. It is thinkable that the toner having a low repose angle brings about the remarkable problems concerning the scattering and sharpness when the electrification amount of the toner is relatively high because the toner is easy to scatter each other at the time of the collision.

The repose angle is a parameter which represents a fluidity of the toner. The lower the repose angle is, the higher the fluidity is. In the present specification, the value measured by means of the powder tester manufactured by Hosokawa Micron K.K. is used as the repose angle (°). In the present invention, the repose angle is not necessarily measured by means of the abovementioned device. Any device may be adopted as long as the measurements are carried out based upon the principle of the abovementioned device.

If the mean roundness is less than 0.945, the tolerance range for the setting condition of the apparatus becomes remarkably narrow because an image density is remarkably apt to reduce when the electrification amount of the toner is set to a slightly higher value. In general, when the roundness of the toner becomes smaller, the toner is more strongly supported on the supporting member and is difficult to fly smoothly. It is thinkable that the image density is reduced because the toner is electrically supported more strongly and is more difficult to fly when the electrification amount is relatively high. On the other hand, if the mean roundness exceeds 0.992, the scattering occurs and the sharpness is reduced at the relatively high electrification amount. The toner having a relatively high electrification amount is easy to accelerate under the influence of an electrical field, and said toner comes into collision with the recording medium in an accelerated state. It is thinkable that the toner having a high mean roundness brings about the remarkable problems concerning the scattering and sharpness when the electrification amount of the toner is relatively high because the toner is easy to scatter each other at the time of the collision.

In the present specification, the mean roundness is a mean value of the values calculated from the following equation:

$$\text{Mean roundness} = \frac{\text{Circumferential length of a circle which is equal to a projection area of a particle}}{\text{Circumferential length of a projection image of a particle}}$$

As the "circumferential length of a circle which is equal to a projection area of a particle" and "circumferential length of a projection image of a particle", the values are used, said values being obtained by measuring said lengths in the aqueous dispersion system by means of a flow-type particle image analyzer (FPIA-1000 or FPIA-2000; made by Toa Iyou Denshi K.K.). In the present invention, the mean roundness is not necessarily measured by means of the abovementioned analyzer. Any device may be adopted as long as the measurements are carried out based upon the abovementioned equation in principle.

The toner of the first invention mentioned above may be produced by any methods, for example, a grinding method, a wet method and the like under the condition that the repose angle and the mean roundness of the toner falls within the desired range.

For example, the toner of the present invention can be obtained by sufficiently mixing at least a binder resin and a colorant and, if necessary, a wax and a charge-control agent, melt-kneading the mixture, cooling the kneaded mixture, subjecting the cooled mixture to coarsely and finely grinding treatments, and then the finely ground product is classified. Further, the toner of the present invention may be prepared by a publicly known wet methods, for example, a granulation method based on an emulsion dispersion process, a suspension polymerization method, an emulsion polymerization method and the like. However, from the viewpoints of production cost and production facility, it is preferable to use the above-mentioned grinding method.

When the toner of the present invention is produced by the grinding method, at least a binder resin and a colorant and, if necessary, a wax and a charge-control agent are firstly mixed and dispersed by means of a mixing machine, such as a ball mill, a twin-shell blender, Henschel mixer, a high-speed dissolver, an internal mixer, a screw extruder, a fall bag and the like. Next, the mixture is heated and kneaded by means of a press kneader, a twin extrusion kneader, a roller and the like. The obtained mixture is coarsely ground by means of a grinder, such as a hammer mill, a jet mill, a cutter mill, a roller mill and the like. Then, the coarsely ground particles are finely ground by means of a grinder, such as a jet mill, a high-speed rotary grinder and the like. The finely ground particles are classified into a desired particle size by means of a classifier, such as an air classifier, an airstream classifier and the like to obtain toner particles.

As the binder resin used in the present invention, the following binders may alone or jointly be used in consideration of fixing and developing properties of the toner: single polymers of styrene or substituted styrene, such as polystyrene, poly-p-chlorostyrene, polyvinyltoluene and the like; styrene copolymers, such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-propyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymers and the like; acrylic resins, such as polyacrylate, polymethyl methacrylate, polyethyl methacrylate, poly-n-butyl methacrylate, polyglycidyl methacrylate, fluorine-containing polyacrylate and the like; polyvinyl chloride, polyvinyl acetate, polyethylene, polypropylene, polyesters, polyurethane, polyamides, epoxy resins, polyol resins, polyvinyl butyrate, polyacrylic acid resin, rosin, modified rosins, terpene resin, phenol resin, urea resin, aliphatic or alicyclic hydrocarbon resins, aromatic petroleum resins, chlorinated paraffin, paraffin wax and the like.

As the colorant included in the toner of the present invention, the following colorants may be selected in consideration of necessary color tone and durability as well as dispersibility to the selected binder resin and the like, but it is not restricted to them.

Any of the publicly known dyeing pigments, for example, carbon black (furnace black, ketchen black, lamp black, thermal black, channel black and the like), phthalocyanine-pigment, azo-pigment, monoazo-pigment, disazo-pigment, azomethine-pigment, quinacridone-pigment, perylene-pigment, anthra-pyrimidine-pigment, isoindolinone-pigment, thren-pigment, benzidine-pigment, naphthol-pigment, xanthene-pigment and the like, such as chrome yellow, azo lake, colcothar, titanium oxide, molybdate orange, ultramarine blue, phthalocyanine blue, aniline blue, phoron yellow, rhodamine 6G, lake, chalcooil blue, thioindico, chrome yellow, quinacridone, benzidine yellow, Hanza yellow G, rose bengal, triallylmethane and the like can alone or jointly be used. The amount of these colorants used is normally 1–30 parts by weight, preferably 3–20 parts by weight in relation to 100 parts by weight of the binder resin.

Various releasants can jointly be used in order to give a releasability to the toner. In particular, a wax may be added in order to increase an anti-offset property and the like of the toner. As such a wax, polyethylene wax, polypropylene wax, carnauba wax, rice wax, sazol wax, montan ester waxes, Fischer-Tropsch wax and the like are exemplified. In case of adding a wax, the content of the wax is preferably 0.5–5 parts by weight in relation to 100 parts by weight of the binder resin in order to obtain its addition effect without causing problems, such as a filming and the like. The abovementioned wax may be used alone or jointly. When the waxes are jointly used, their total contents may be within the range mentioned above.

As the electrification adjustor (charge-control agent) added to the toner of the present invention, nigrosine dyes, alkoxylated amines, quaternary ammonium salts, alkyl amides, metallic complexes of azo dyes, tetraphenylboron derivatives, Zn salts of salicylic acid derivatives, metallic complexes of alkyl salicylates, metallic salts of higher fatty acids and the like are used in consideration of a color tone and an electrification amount of the toner. It is desirable that they are internally added in the range of 1–10 parts by weight, preferably 2–8 parts by weight in relation to 100 parts by weight of the binder resin. If less than 1 part by weight of the electrification adjustor is added internally, it becomes difficult to saturatedly electrify the toner uniformly and quickly, and the image density decreases to the lower value than the allowable density. If more than 10 parts by weight of the electrification adjustor is added internally, the electrification amount of the toner becomes excessive, and a fogging of the image exceeds the allowable level.

The repose angle of the toner can be controlled by adding an external additive to the toner particles and mixing them, or appropriately adjusting an average particle size of primary particle of the external additive, and an average particle size, a particle size distribution, a mean roundness and the like of the toner particles. A factor which can control the repose angle of the toner is referred to as a repose angle controlling factor hereinafter.

When the external additive is added to the toner particles, the repose angle is generally decreased. As the external additive, silica fine particles (silicon dioxide, aluminum silicate, sodium silicate, potassium silicate, zinc silicate, magnesium silicate and the like) and metallic oxide fine particles (titanium oxide, aluminum oxide, tin oxide, stibium oxide, zinc oxide, zirconium oxide, strontium titanate, barium titanate and the like) are exemplified. As the other external additive, a cleaning auxiliary consisting of fine powder of a resin, such as polymetyl methacrylate and fluoropolymer (polyvinylidene fluoride, polytetrafluoroethylene), an anti-caking agent, a fixing auxiliary, such as polyolefins having a low molecular weight, or a lubricating agent for preventing a sticking of a developing blade, such as metallic salts of fatty acids (lead stearate, aluminum stearate and the like) may also be added. The abovementioned external additives can be used alone or jointly. Further, these external additives may previously be subjected to a surface treatment, such as a hydrophobicizing treatment.

Although an amount of the external additive used is not restricted in particular because said amount can suitably be determined depending on the desired repose angle and the other repose angle controlling factors, such as the average particle size of primary particle of the external additive, and the average particle size, the particle size distribution, the mean roundness and the like of the toner particles, it is desirable to use the external additive in the ratio of 0.1–5% by weight, preferably 0.3–3% by weight relative to the toner particles. When two or more kinds of external additives are used, it is desirable that the total amounts of the external additives are fallen within the abovementioned range.

Although the publicly known mixer can be used as the means for mixing the external additive, it is preferable to use, for example, a high-speed fluid mixer. As the high-speed fluid mixer, Henschel mixer, supermixer, micro-speed mixer and the like are exemplified. After the external additive is added and mixed with other ingredients of the toner, it is preferable to remove agglomerates and impurities by using a sieve.

Further, the repose angle may also be controlled by appropriately selecting the kind and an adding amount of the toner components constituting the toner, for example, the binder resin, the colorant, the wax and the electrification adjustor.

The mean roundness of the toner may be controlled by any methods. For example, the mean roundness can be controlled by subjecting the toner particles to a surface treatment with, for example, a surface-modifying device before the external additive is added to the toner in order to control the repose angle as mentioned above.

As the device for modifying a surface used for controlling the mean roundness, the following equipments are exemplified: systems wherein a method for impacting a particle in a high-speed air flow is applied, such as Hybridization system (made by Nara Kikai Seisakusho K.K.), Cosmos system (made by Kawasaki Jukogyo K.K.), Inomizer system (made by Hosokawa Micron K.K.) and a Turbo Mill (made by Turbo Kogyo K.K.); systems wherein a dry mechanochemical method is applied, such as Mechanofusion system (made by Hosokawa Micron K.K.) and Mechano Mill (made by Okada Seiko K.K.); systems wherein a method for modifying a particle in a heated air flow is applied, such as Surfusing System (made by Nippon Pneumatic Kogyo K.K.) and Heat treatment apparatus (made by Hosokawa Micron K.K.); systems wherein a wet coating method is applied, such as Dispercoat (made by Nisshin Engineering K.K.) and Coatmizer (made by Freund Sangyo K.K.); and the like.

Figure 6:
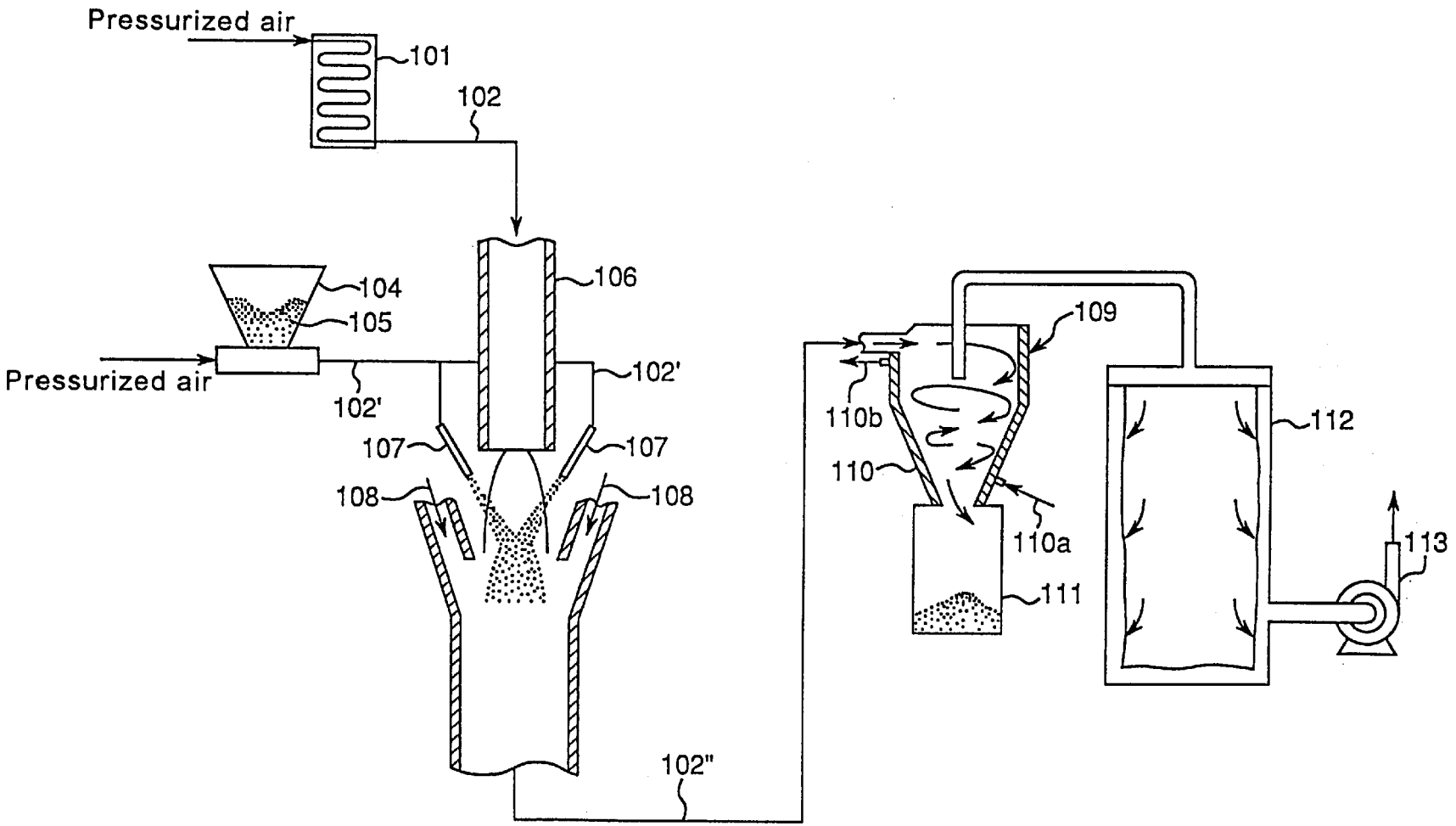
FIG. 6 is a drawing that shows a schematic constructional view of a surface-modifying device for the toner.

Among the abovementioned devices for modifying a surface, the Surfusing System (made by Nippon Pneumatic Kogyo K.K.) is most preferable since it can control the mean roundness to a great degree for achieving the objective of the present invention. By referring to FIG. 6, said system will be explained hereinafter. As illustrated in FIG. 6, a high-temperature and high-pressure air generated in a heated air generator 101 is jetted from a jet nozzle for the heated air 106 through an introduction tube 102. A predetermined amount of toner particles (sample) 105 to be subjected to a surface-modifying treatment in a dispenser 104 is transported by an action of pressurized air through an introduction tube 102', and jetted into the heated air from a jet nozzle for the sample 107 installed around the periphery of the jet nozzle for the heated air 106. In this case, it is preferable to provide a predetermined tilt to jet nozzle for the sample 107 with respect to the jet nozzle for the heated air 106 so as not to allow the jetted flow from the jet nozzle for the sample 107 to cross the heated air flow. The toner particles jetted in this manner are uniformly subjected to the surface-modifying treatment when they are instantaneously come in contact with the high-temperature air flow.

Next, the toner particles which have been subjected to the surface-modifying treatment are rapidly cooled down by a cold air flow that is introduced from an introduction section for the cold air flow 108. Such a rapid cooling prevents the toner particles from adhering to a wall of the device and from agglomerating the toner particles said rapid cooling improving the yield of the toner. The modified toner particles are then collected into a cyclone 109 through an introduction tube 102", and accumulated in a product tank 111. After the toner particles are collected, the transporting air from the cyclone 119 is induced to pass through a bagfilter 112 in which a fine powder is removed, and then discharged to the atmosphere through a blower 113. A cooling jacket 110, in which a cooling water (110*a* and 110*b*) is circulated, is installed in the cyclone 109 in order to prevent an agglomeration of the toner particles inside the cyclone by cooling said particles with the cooling water.

When the surface-modifying treatment is carried out in this manner in order to control the mean roundness of the toner particles, it is preferable to add an external additive to the toner prior to said treatment. By an addition of the external additive, the dispersibility of the toner particles in said treatment can be improved and a variability of shape of the toner particles can be controlled. A suitable addition amount of the external additive is 0.1–5% by weight relative to the toner particles. As the external additive, the above-mentioned external additive, which can be used in order to control the repose angle of the toner, can be used.

In the case where the surface-modifying treatment is carried out by using the above-mentioned device, the mean roundness of the toner can easily be controlled by a suitable fine adjustment of the device conditions, for example, a maximum treatment temperature, a residence time, a dispersion concentration of the powder, a temperature of the cooling air, a temperature of the cooling water and the like. In particular, it is preferable to set the treatment temperature within the range of from 150 to 450° C.

In the toner of the second invention, the repose angle is 3.0–34.0°, preferably 7.0–30.0°, more preferably 10.0–26.0°, and the mean roundness is 0.945–0.992, preferably 0.961–0.981, more preferably 0.964–0.971, and the content of the toner whose particle size is 9 μm or more is 23% by weight or less, preferably 20% by weight or less, more preferably 15% by weight or less, most preferably 10% by weight or less.

If the repose angle exceeds 34.0°, an image density is remarkably reduced and the tolerance range for the setting condition of the apparatus becomes remarkably narrow when the electrification amount of the toner is set to a slightly higher value. In general, a toner having a relatively high electrification amount requires a relatively high applied voltage at the time of flying from the toner-supporting member to a recording medium. It is thinkable that the toner having the abovementioned high repose angle becomes difficult to fly and the image density is remarkably reduced when the electrification amount is slightly increased under the constant applied voltage because said toner requires higher applied voltage. On the other hand, if the repose angle is less than 3.0°, the scattering occurs, and the sharpness is reduced when the toner has a relatively higher electrification amount. Further, the toner having a relatively high electrification amount is easy to accelerate under the influence of an electrical field, and said toner comes into collision with the recording medium in an accelerated state. It is thinkable that the toner having a low repose angle brings about the remarkable problems concerning the scattering and sharpness when the electrification amount of the toner is relatively high because the toner is easy to scatter each other at the time of the collision.

When the content of the toner whose particle size is 9 μm or more exceeds 23% by weight, the scattering occurs and the sharpness is reduced when the electrification amount of the toner is relatively high, and the tolerance range for the setting condition of the apparatus becomes remarkably narrow. Further, it is thinkable that if the content of the toner particles having a large particle size is too much, although the flight of the toner from the toner-supporting member to the recording medium is smoothly carried out when the electrification amount of the toner is relatively high, the toner is scattered and the sharpness thereof is reduced at the time of impacting the toner particles on the recording medium because the weight per one particle of the toner is heavy and an impact force at the time of said impact is increased.

In the present specification, the value obtained by measuring the particle size distribution of the toner by means of Coulter counter MULTISIZER (manufactured by Coulter Co.) is used as the content of the toner whose particle size is 9 μm or more (% by weight). In the present invention, the distribution of the particle size is not necessarily measured by means of the abovementioned device. Any device may be adopted as long as the measurements are carried out based upon the principle of the abovementioned device.

If the mean roundness is less than 0.945, the tolerance range for the setting condition of the apparatus becomes remarkably narrow because an image density is highly apt to reduce when the electrification amount of the toner is set to a slightly higher value. In general, when the roundness of the toner becomes smaller, the toner is more strongly supported on the supporting member and is difficult to fly smoothly. It is thinkable that the image density is reduced because the toner is electrically supported more strongly and is more difficult to fly when the electrification amount is relatively high. On the other hand, if the mean roundness exceeds 0.992, the scattering occurs and the sharpness is reduced at the relatively high electrification amount. The toner having a relatively high electrification amount is easy to accelerate under the influence of an electrical field, and said toner comes into collision with the recording medium in an accelerated state. It is thinkable that the toner having a high mean roundness brings about the remarkable problems concerning the scattering and sharpness when the electrification amount of the toner is relatively high because the toner is easy to scatter each other at the time of the collision.

The toner of the second invention mentioned above may be prepared by any methods as long as the repose angle, the mean roundness and the content of the toner whose particle size is 9 μm or more are fallen within the desired ranges.

For example, the second toner can be obtained by preparing the toner particles by the same method as the above-mentioned production method of the first toner and then classifying them by means of a device for classifying the particles having the large particle size, such as DS classifier (made by Nippon Pneumatic K.K.), Elbow Jet classifier (made by Nittetsu Kyogo K.K.) and the like.

As regards the controlling methods of the repose angle and the mean roundness of the second toner, the same methods as those used in the aforesaid toner of the first invention may be adopted.

As the toner-components constituting the second toner, such as a binder resin, a colorant, a wax and a charge-control agent, the same components as those used in the first toner may be employed.

The toners of the first and second inventions as stated above are preferably applied to an image-forming apparatus employing a toner-jetting system (a direct recording method) in which a toner is jettingly adhered to a recording medium, more particularly, in which (i) a recording electrode and a back electrode are arranged on the opposite side of a toner-supporting member, (ii) a recording medium, such as a paper and the like is conveyed to a space between the recording electrode and the back electrode, (iii) a voltage corresponding to an image signal is impressed to the recording electrode to afford the toner an electrostatic force, and (iv) the toner from the toner-supporting member is jettingly adhered to the recording medium in a direct manner in response to a state of the applied voltage. The image-forming apparatus (the direct printing apparatus) employing the abovementioned toner-jetting system will be explained in detail hereinafter by using the drawings attached.

FIG. 1 shows an image-forming apparatus (a direct printing apparatus) indicated wholly by the number 2, to which. the toner of the present invention can be applied. The printing apparatus 2 has a sheet-feed station indicated wholly by the number 4. The sheet-feed station 4 has a cassette 6 wherein sheets 8, such as papers and the like are received in a laminated state. A sheet-feeding roller 10 arranged above the cassette 6 rotates while it contacts with the uppermost sheet 8 to send the sheet 8 to an inside of the printing apparatus 2. In the neighborhood of the sheet-feeding roller 10, a pair of timing rollers 12 is arranged. The timing rollers supply the sheet 8 that has been sent from the cassette 6 to a printing station (the whole thereof is shown by the number 16), in which an image made of a printing material is formed on the sheet 8, along a passageway 14 for a sheet shown by a dotted line. Further, the printing apparatus 2 has a back roller 40 for guiding the flying toner particles which is opposite to the printing station 16. Furthermore, the printing apparatus 2 has a fixing station 18 for permanently fixing the image made of the printing material on the sheet 8 and a final stack station 20 for receiving the sheet 8 on which the image made of the printing material has been fixed.

Figure 2:
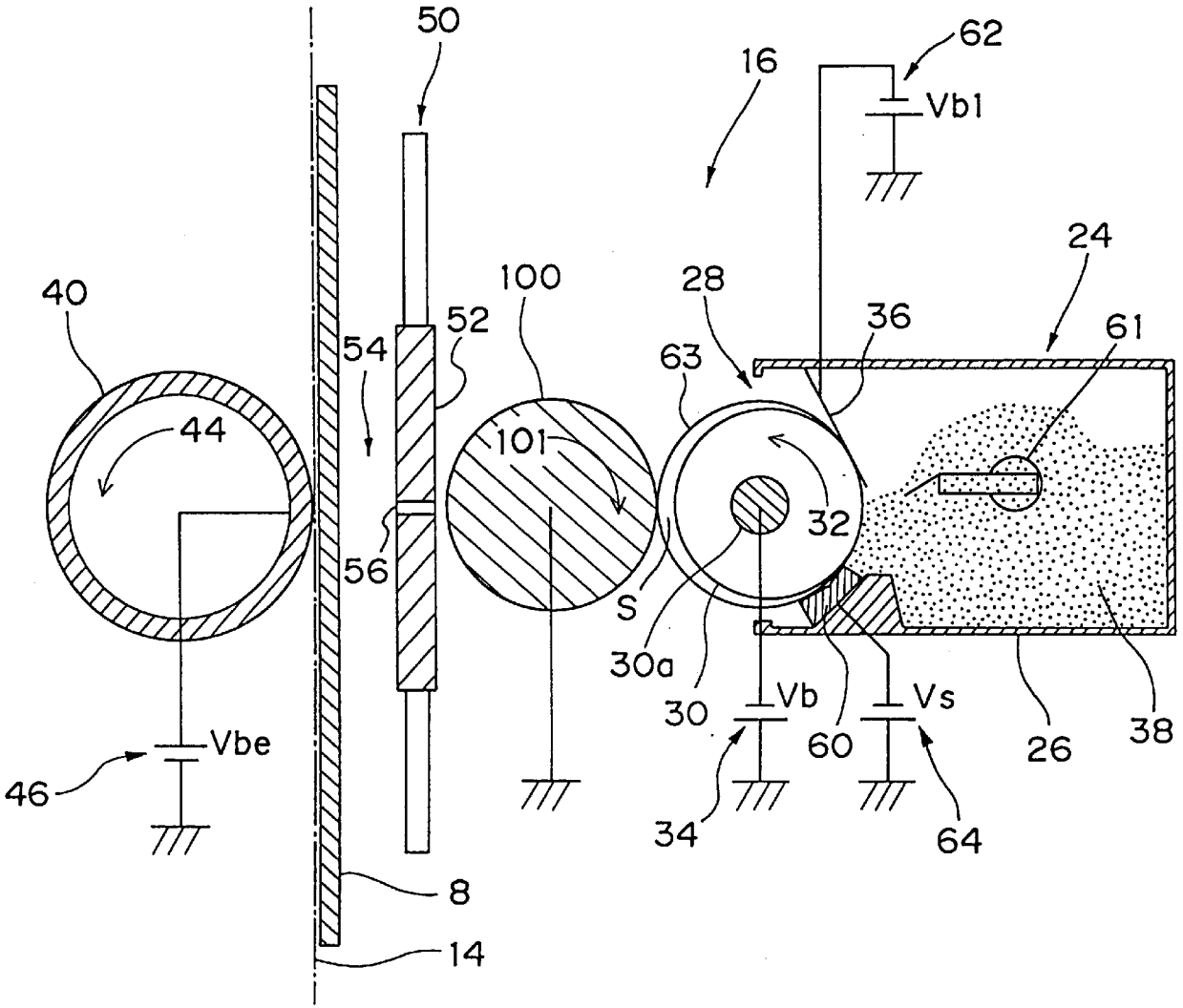
FIG. 2 is a drawing that shows a schematic constructional view for explaining the construction of a printing station, a printing head and a back roller in the apparatus of FIG. 1.

A diagrammatic construction of the printing station 16 and the back roller 40 is shown in FIG. 2. The printing station 16 has a toner-supplying device (the whole thereof is shown by the number 24) which is faced to the passageway 14 for a sheet. The toner-supplying device 24 has a container 26 in which an opening 28 is formed, said opening being opposite to the passageway 14 for a sheet. In the neighborhood of the opening 28, a toner-supplying roller 30 which is rotatable in the direction of an arrow 32 is supported. The toner-supplying roller 30 which is made of a conductive material is electrically connected to a bias power source 34 which is a direct current source. A blade 36 constituted of a plate which is preferably made of rubber or stainless steel is arranged in such a way that it is in contact with a sleeve 63 which is sheathed on the toner-supplying roller 30.

The container 26 contains the printing material, that is, toner particles 38. The toner particles 38 are supplied to the sleeve 63, which is sheathed on the outside peripheral surface of the toner-supplying roller 30, by a supplying means received in the container 26, that is, an agitator 61 and are conveyed according to rotation of the toner-supplying roller 30. The agitator 61 is rotatably arranged and prevents a blocking and the like of the toner particles 38 contained in the container 26 while it remove the toner particles 38 toward the toner-supplying roller 30 by its rotation. As the toner-supplying roller 30, a cylindrical roller made of SK steel, aluminum or stainless steel and the like or a metallic roller whose outside peripheral surface is coated with a conductive elastic material (nitrile rubber, silicone rubber, styrene rubber, butadiene rubber, urethane rubber and the like) can be used. A bias voltage (Vb) from the bias power source 34 is applied to the toner-supplying roller 30.

The sleeve 63 is a cylinderical sleeve having a slightly longer peripheral length than the outside peripheral length of the toner-supplying roller 30 and is sheathed on the toner-supplying roller 30, as shown in FIG. 2. As the sleeve 63, a cylindrical sleeve formed from the following sheets can be employed: a flexible resin sheet made of resin, such as polycarbonate, nylon, fluororesin and the like, a sheet prepared by adding carbon, whisker, metallic powder and the like to the abovementioned resins, a metallic thin film made of nickel, stainless steel, aluminum and the like, or a sheet prepared by laminating the abovementioned resin sheet and the metallic thin film.

The toner-supplying roller 30 on which the sleeve 63 is sheathed is rotatably supported by a supporting axis 30*a*, and is connected to a driving source not shown in the drawing, said roller being driven to rotate toward the direction of an arrow 32 by the driving source. When the toner-supplying roller 30 rotates toward the direction of the arrow 32, the sleeve 63 rotates depending on the rotation of the toner-supplying roller 30, and the outside surface of the sleeve 63 which covers a space S rubs slidingly on the surface of an intermediate roller 100 in a state that a suitable nip width is maintained. Further, the intermediate roller 100 is supported in such a way that it rotates toward the direction of an arrow 101, and is connected to a driving source not shown in the drawing 1 said roller being driven toward the direction of the arrow 101 by the driving source. As the intermediate roller 100, a roller formed from a conductive or dielectric metal, resin, rubber and their composite material, for example, a metal roller whose surface is coated with resin layer and the like can be used. Further, in the present embodiment, although the intermediate roller 100 is grounded, a suitable voltage may be applied in response to the image-forming condition.

A blade 36 is installed at the part of the container 26 which is opposed to the top of the toner-supplying roller 30, said blade being thrust against the diagonal upper part of the back surface of the toner-supplying roller 30 via the sleeve 63. As the blade 36, a spring metallic thin plate made of SK steel, stainless steel or phosphor bronze, a fluororesin plate, a nylon plate, a rubber plate or their composite plates, such as a stainless steel thin plate whose surface or edge is covered with rubber or resin, and the like may be used. A blade bias (Vb1) from a blade bias power source 62 is applied to the blade 36. There is a predetermined potential difference between the blade bias (Vb1) and the bias voltage (Vb). By taking advantage of this potential difference, the electrification amount of the toner particles 38 can be controlled, and the time for reaching the electrification amount of the toner particles 38 to the necessary value in the initial stage wherein a toner layer is formed on the intermediate roller 100 can be shortened.

A bottom-sealing element 60 which is prepared by, for example, laminating a silicone rubber sheet on the surface of an elastic layer made of foamed urethane is installed at the part of the container 26 which is opposed to the bottom of the toner-supplying roller 30, said bottom-sealing element 60 being contacted with the outside peripheral surface of the toner-supplying roller 30 via the sleeve 63. A bottom-sealing bias (Vs) from a bottom-sealing bias power source 64 is impressed to the bottom-sealing element 60.

Between the intermediate roller 100 and the passageway 14 for a sheet through which the sheet 8 is conveyed, a printing head (the whole thereof is shown by the number 50) is fixed. Although the printing head 50 is composed of a flexible printing circuit-board (a partition wall) 52 having a thickness of about 100–200 $\mu$m, it is not limited to this circuit-board, and a printing circuit formed on the rigid thin plate made of ceramic, glass, resin plate and the like may be used.

At the part situated in a printing area 54 of the printing head 50, there are plural holes 56 having an inside diameter of about 25–200 $\mu$m that is substantially larger than the average particle size (about from several micrometers to ten-odd micrometers) of the toner particles 38. With respect to the inside diameter of the holes, the larger, the more preferable from the viewpoint of preventing the toner particles from clogging, and the smaller, the more preferable from the viewpoint of increasing an image quality. These plural holes 56 are formed at regular intervals along a line which is parallel with an axis of the toner-supplying roller 30. Alternatively, the plural holes 56 may be formed at regular intervals along plural lines which are parallel with the axis of the toner-supplying roller 30.

A back roller (the whole thereof is shown by the number 40) is arranged across the passageway 14 for a sheet from the printing head 50. This back roller 40 may be composed of metal, such as SK steel, aluminum or stainless steel. Alternatively, the back roller 40 may be a roller obtained by coating the outside peripheral surface of a metallic roller with a conductive elastic material (nitrile rubber, silicone rubber, styrene rubber, butadiene rubber, urethane rubber and the like) or a dielectric material (dielectric resin, dielectric rubber and the like). The back roller 40 is connected to a power source 46 which supplies a back electrode voltage (Vbe) having the predetermined polarity. The back electrode voltage (Vbe) electrically attracts the charged toner-particles 38 on the intermediate roller 100 toward the direction of the back roller 40 in a printing area 54 where the intermediate roller 100 is opposed to the back electrode 40. The level and the polarity of the impressed voltage can appropriately be set in response to characteristics of the toner to be used, printing conditions, circumstances and the like.

A movement of the toner particles in an initial stage of a formation of a toner layer on the intermediate roller 100 will be illustrated hereinafter by using FIG. 2–FIG. 5.

In the state where the toner-supplying roller 30 and the agitator 61 are rotated by means of the driving source which is not shown in the drawings, the toner particles 38 in the container 26 are forcibly moved toward the direction of the toner-supplying roller 30 by an agitating action of the agitator 61 (see FIG. 2). On the other hand, the sleeve 63 rotates dependently toward the direction of the arrow 32 by a frictional force against the toner-supplying roller 30, and the toner particles 38 which are in contact with the sleeve 63 are subjected to a conveying force toward the direction of the arrow 32 caused by the contact with the sleeve 63 and the electrical force. Thereafter, when the toner particles 38 arrive at a wedge-shaped uptake portion that is formed between the sleeve 63 and the edge of blade 36 and reach a thrusting portion against the blade 36, they are not only uniformly applied to the surface of the sleeve 63 but also are electrified in a predetermined polarized state. In the present embodiment, although a toner comprising toner particles 38 to be negatively electrified is used, and the illustration is carried out for the case wherein the toner particles 38 are negatively electrified by a friction, a method for electrifying the toner particles 38 is not restricted to this embodiment. Therefore, each outside peripheral region of the toner-supplying roller 30 that are passed through a contact area between the toner-supplying roller 30 and the blade 36 carries a thin layer of the toner particles 38 which are negatively electrified. Further, as shown in FIG. 2, the toner-supplying roller 30 is supplied with the bias voltage (Vb) from the power source 34.

When the toner particles 38 which are carried on the sleeve 63 are conveyed to the opposite region to the intermediate roller 100 according to the rotation of the sleeve 63 caused dependently by a rotation of the toner-supplying roller 30, they are adhered on the surface of the intermediate roller 100 on the basis of a potential difference between the bias voltages impressed to the intermediate roller 100 and the toner-supplying roller 30. In such a case, the sleeve 63 which is in contact with the intermediate roller 100 is in noncontact with the toner-supplying roller 30 via the space S. Therefore, the sleeve 63 softly and uniformly comes into contact with the intermediate roller 100 with the suitable nip width to form a uniform toner layer on the intermediate roller 100. Further, the thickness and the state of the toner layer formed on the intermediate roller 100 can be changed by making the difference between a circumferential velocity of the intermediate roller 100 and that of the sleeve 63 and/or setting the rotating direction of the intermediate roller 100 to the opposite direction to that of the sleeve 63.

The toner particles 38 passed through the opposite region to the intermediate roller 100 are successively conveyed toward the direction of the arrow 32 with the sleeve 63, and a consumed pattern of the toner layer on the sleeve 63 is erased at the time of passing through the space between the sleeve 63 and the bottom sealing element 60, and then the abovementioned operation is repeated.

In such a manner, the layer of the toner particles 38 having the predetermined electrification amount and thickness is formed on the intermediate roller 100 and conveyed toward the rotating direction shown by the arrow 101 according to the rotation of the intermediate roller 100.

Figure 3:
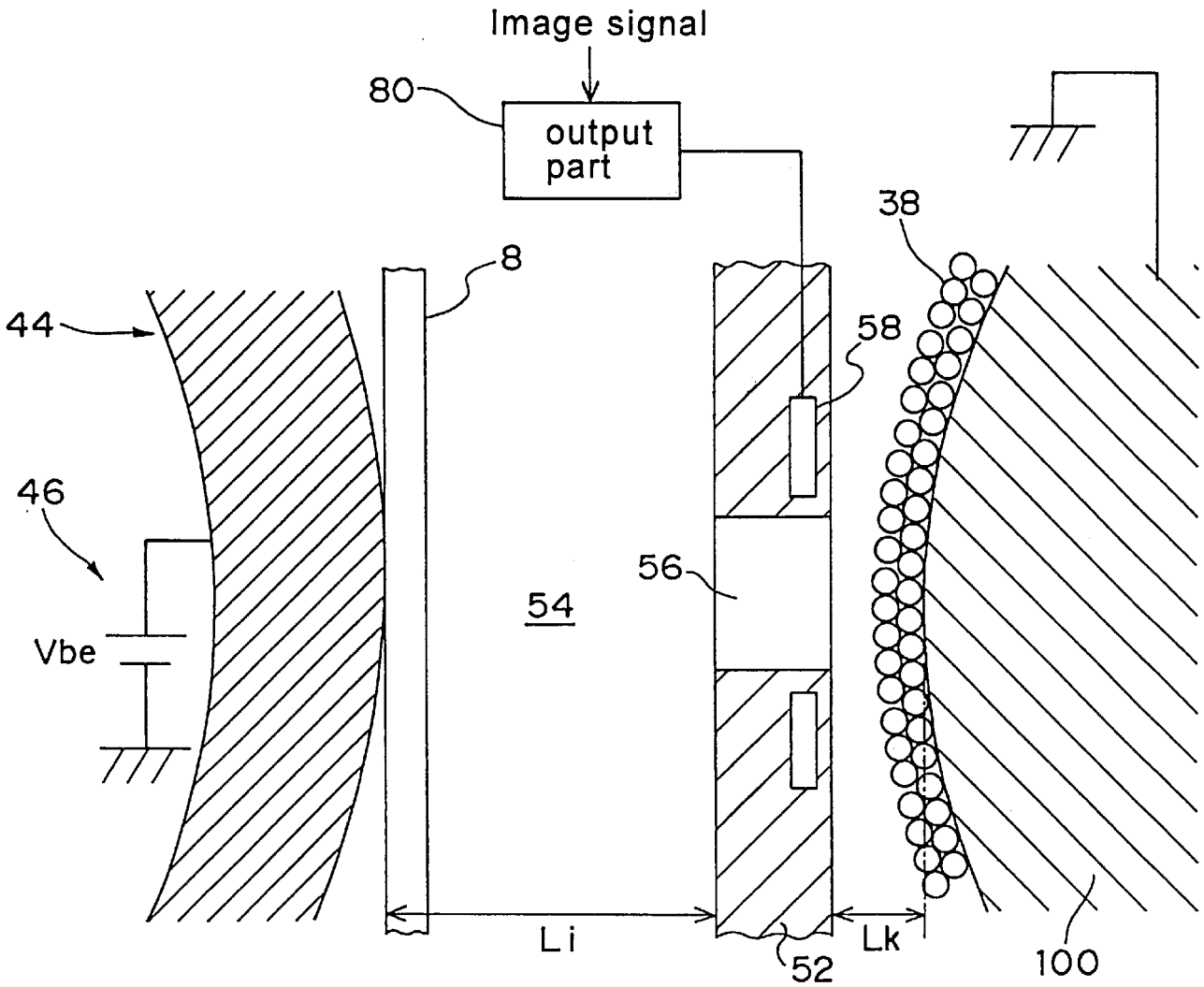
FIG. 3 is an enlarged schematic view of a neighborhood of a printing area in FIG. 2.
Figure 4:
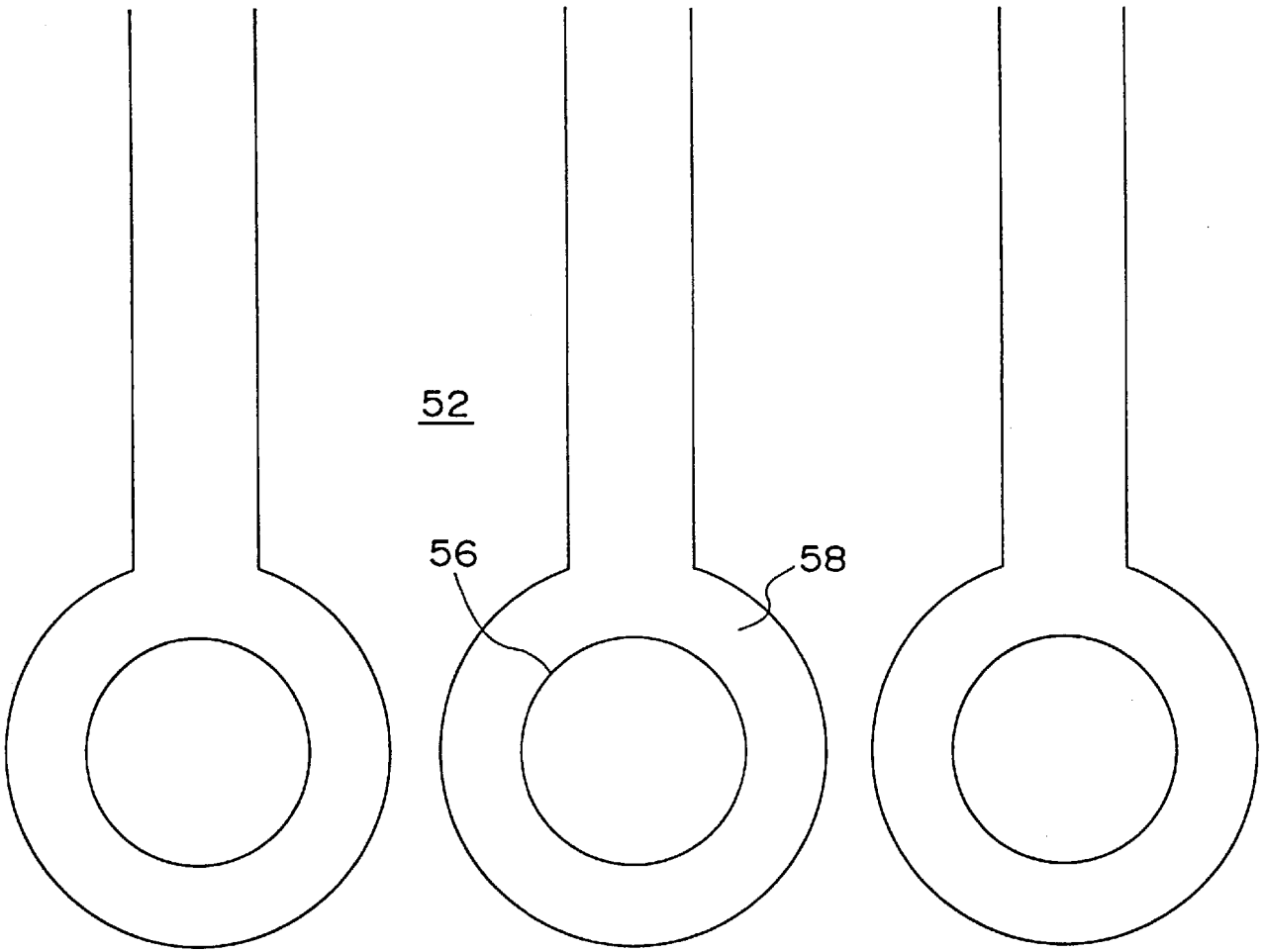
FIG. 4 is an enlarged schematic view of holes for explaining a recording electrode.

FIG. 3 is an enlarged diagrammatic drawing that shows a neighborhood of the printing area 54 shown in FIG. 2. A flexible printing circuit board 52 has the doughnut-shaped recording electrodes 58 surrounding each hole 56 (see FIG. 4). Although the recording electrode 58 is continuous in a peripheral direction, in the present embodiment, a shape of the recording electrode 58 is not limited to said shape. For example, the recording electrode 58 may have a horseshoe-shape which is prepared by cutting a part of the doughnut-shape or a similar shape to the horseshoe-shape. As shown in FIG. 3, the recording electrode 58 is arranged on the opposite side of the intermediate roller 100 in the flexible printing circuit-board 52. The recording electrode 58 is connected to an output section of a printing signal (a driver) 80, said output section 80 being connected to an image signal-treatment section (not shown in the drawing). The output section 80 of a printing signal impresses the printing signal to the recording electrode 58 on the basis of the output of an image signal from the image signal-treatment section. In FIG. 3, the same numbers as those used in FIG. 2 have the same meanings as those described in relation to FIG. 2, so that their explanations are omitted.

Figure 5:
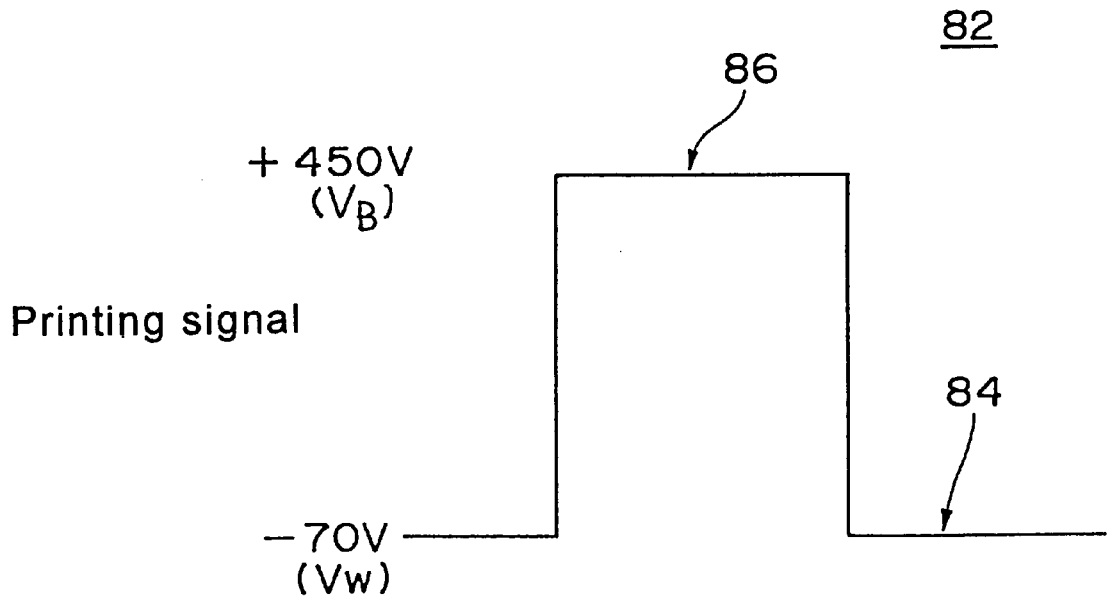
FIG. 5 shows an example of voltage-waveform of a printing signal.

FIG. 5 shows a part of voltage-waveform of the printing signal. In the present embodiment, a non-printing voltage 84 (Vw) is set to −70 volts, and a printing voltage 86 ($V_B$) is set to +450 volts.

Therefore, when the non-printing voltage 84 (Vw) is impressed to the recording electrode 58, a group of negatively electrified toner particles 38 which exist at the opposite side of the recording electrode 58 on the intermediate roller 100 electrically repels the above-mentioned recording electrode 58 to which the non-printing voltage 84 (Vw) having negative polarity is impressed, and remains on the intermediate roller 100. On the other hand, when the printing voltage 86 ($V_B$) is impressed to the recording electrode 58, a group of negatively electrified toner particles 38 mentioned above is electrically not only attracted to the recording electrode 58 to be activated, but also filed out from the intermediate roller 100 toward the holes 56 by an effect of an electrical field between the intermediate roller 100 and the back roller 44. The released toner particles pass through the holes 56, and they are electrically attracted (induced) toward the back roller 44 and jettingly adhered to the sheet 8.

In the abovementioned apparatus, the intermediate roller is used as the toner-supporting member which supports the toner particles just before flying. However, the toner of the present invention may also be applied to an apparatus having a construction in which the toner particles are directly filed from the toner-supplying roller to the recording medium (that is, an apparatus equipped with the toner-supplying roller as the toner-supporting member) without using the intermediate roller. In this case, the toner-supplying roller may have a sleeve or no sleeve.

When the first and second toners of the present invention are applied to such image-forming apparatuses (direct printing apparatuses), the clogging hardly occurs in the holes of the recording electrodes, and the obtained image has an excellent image quality even if an electrification amount of the toner is changed to some extent by a change of circumstances. In other words, the tailing, the scattering, the reduction of the image density and the reduction of the sharpness do not occur on the obtained image. Further, when the first and second toners of the present invention are used, the tolerance range of setting conditions of the apparatus widens because said toners have a broad allowable range for the electrification amount.

EXAMPLES

Experimental Example 1

(Production example of polyester resin A)

Into a four-necked glass flask equipped with a thermometer, a stirrer, a reflux condenser and a tube for introducing a nitrogen gas, polyoxypropylene(2,2)-2,2-bis (4-hydroxyphenyl)propane, polyoxyethylene(2,2)-2,2-bis (4-hydroxyphenyl)propane, isododecenyl succinic anhydride, terephthalic acid and fumaric acid, a weight ratio of said components being adjusted to 82:77:16:32:30, together with dibutyltin oxide as a polymerization initiator were charged. The reaction was carried out at 220° C. by heating the mixture with a mantle heater under a nitrogen gas atmosphere while said mixture was stirred. A polyester resin A thus obtained had a softening point (Tm) of 110° C., a glass transition point (Tg) of 60° C. and an acid value of 17.5 KOH mg/g.

(Production example of polyester resin B)

Styrene and 2-ethylhexyl acrylate were mixed in a weight ratio of 17:3.2, and the mixture was charged into a dropping funnel together with dicumylperoxide as a polymerization initiator. Into a four-neck glass flask equipped with a thermometer, a stirrer, a reflux condenser and a tube for introducing a nitrogen gas, polyoxypropylene(2,2)-2,2-bis (4-hydroxyphenyl)propane, polyoxyethylene(2,2)-2,2-bis (4-hydroxyphenyl)propane, isododecenyl succinic anhydride, terephthalic acid, 1,2,4-benzenetricarboxylic acid anhydride and acrylic acid, a weight ratio of said components being adjusted to 42:11:11:11:8:1, together with dibutyltin oxide as a polymerization initiator were charged. This flask was placed in a mantle heater, and styrene and said acrylate were dropped into the flask from the dropping funnel while the mixture was stirred at 135° C. under a nitrogen gas atmosphere, and then the mixture was heated to 230° C. at which the reaction was carried out. A polyester resin B thus obtained had a softening point of 150° C., a glass transition point of 62° C. and an acid value of 24.5 KOH mg/g.

(Production example of polyester resin C)

A reflux condenser, a water separator, a tube for introducing a nitrogen-gas, a thermometer and a stirrer were attached to a four-necked flask (5 liter) and this flask was placed in a mantle heater. Into this flask, 1376 g of bisphenol-propylene oxide adduct and 472 g of isophthalic acid were charged (COOH/OH=1.4), and the dehydropolycondensation was carried out at 240° C. while a nitrogen gas was introduced into the flask. Thus, a low molecular weight polyester c (Mw=5000; Tg=61° C.) was obtained.

A reflux condenser, a water separator, a tube for introducing a nitrogen gas, a thermometer and a stirrer were attached to a four-necked flask (5 liter), and this flask was placed in a mantle heater. Into this flask, 1720 g of bisphenol-propylene oxide adduct, 860 g of isophthalic acid, 119 g of succinic acid, 129 g of diethyleneglycol, and 74.6 g of glycerin were charged (OH/COOH=1.2), and dehydropolycondensation was carried out at 240° C. while a nitrogen gas was introduced into the flask. Thus, a polyester c for polymerization (Mw=7000; Tg=42° C.) was obtained.

Then, 4200 parts by weight of the low molecular weight polyester c and 2800 parts by weight of the polyester c for polymerization were charged into a Henshel mixer, and sufficiently dryblend to prepared a homogeneous mixture. Next, the obtained mixture was charged into a heating kneader, and 100 parts by weight of diphenylmethane-4,4-diisocyanate was added to the mixture (NCO/OH=1.0), and reaction was carried out for one hour at 120° C. The percentage of NCO was measured in order to confirm the fact that the residual free isocyanate groups no longer existed, and then the reaction product was cooled to obtain a polyester resin C having urethane bonds. This polyester resin C (a glass transition point (Tg): 65° C.; a softening point (Tm): 140° C.; an acid value: 25 KOHmg/g) contained 20% by weight of the components which are insoluble in the solvent (methyl ethyl ketone).

(Production example of polyester resin D)

A reflux condenser, a water separator tube for introducing a nitrogen gas, a thermometer and a stirrer were attached to a four-necked flask (2 liter), and this flask was placed in a mantle heater. Into this flask, polyoxypropylene(2,2)-2,2-bis (4-hydroxyphenyl)propane (PO), polyoxyethylene (2,0)-2, 2-bis(4-hydroxyphenyl)propane (EO), fumaric acid (FA) and terephthalic acid (TPA) were charged in a mole ratio of 5:5:5:4. The mixture was heated to react under stirring, while a nitrogen gas was introduced into the flask. The progress of this reaction was pursued by measuring an acid value of a reaction mixture. When an acid value was reached to the predetermined value, the reaction was terminated to obtain a polyester resin D (a number-average molecular weight (Mn): 4800; a ratio of a weight-average molecular weight (Mw) to a number-average molecular weight (Mn) (Mw/Mn): 4.0; a glass transition point: 58° C.; and a softening point: 100° C.).

Example 1.1

Forty parts by weight of polyester resin A, 60 parts by weight of polyester resin B, 2 parts by weight of polyethylene wax (800P; made by Mitsui Sekiyu Kagaku Kogyo K.K.; melt viscosity: 5,400 cps at 160° C.; softening point: 140° C.), 2 parts by weight of polypropylene wax (TS-200; made by Sanyo Kasei Kogyo K.K.; melt viscosity: 120 cps at 160° C.; softening point: 145° C.; acid value: 3.5 KOHmg/g), 8 parts by weight of acid carbon black (Mogul-L; made by Cabot K.K.; pH 2.5; average primary particle size: 24 nm) and 2 parts by weight of a negative charge-control agent represented by the following formula (I):

(I)

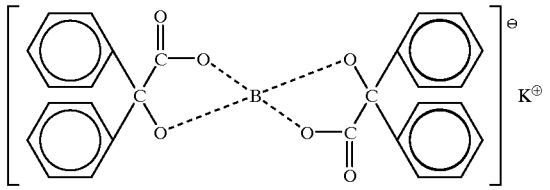

were sufficiently mixed by Henschel Mixer, and melted and kneaded by a twin extrusion kneader. The kneaded mixture was cooled, coarsely ground by a hammer mill, and finely pulverized by a jet pulverizer, and then classified to obtain toner particles having a volume-average particle size of 7.5 μm.

The hydrophobic silica (TS-500 supplied by Cabot K.K.) (0.5% by weight) was added to the toner particles, and the result and admixture was mixed to obtain a toner. The resultant toner was surface-treated by means of the surface-modifying device (Surfusing system manufactured by Nippon Pneumatic Kogyo K.K.) as shown in FIG. 6, and then the hydrophobic silica (R972 supplied by Nippon Aerosil K.K.)(0.21% by weight) and the hydrophobic silica (NAX50 supplied by Nippon Aerosil K.K.)(0.21% by weight) were added to the toner particles, and the resultant admixture was mixed. Then the resultant mixture was filtered through a vibration sieve (106 $\mu$m mesh) to obtain a toner. The toners having the various roundness were obtained by appropriately changing the heat-treating temperature of the surface-modifying device.

Examples 1.2–1.6 and Comparative Examples 1.1–1.4

Toners were obtained by carrying out the same method as described in example 1.1 except that the binder resins, the waxes, the colorants, the charge-control agents and the inorganic fine particles which were added after the surface treatment shown in Table 1 were used in an amount shown in said table, and that the grinding conditions including the kinds of the pulverizer and the like were appropriately changed.

The manufacturing conditions were summarized in Table 1.

TABLE 1

| | Binder resin (parts by weight) | Wax (parts by weight) | Colorant (parts by weight) | Charge-control agent (parts by weight) | Inorganic fine particles added after the surface treatment (% by weight) |
|---|---|---|---|---|---|
| Ex.1.1 | PESA(40) PESB(60) | 800P(2) TS200(2) | Mogul L(8) | Formula (I) (2) | R972(0.21) NAX50 (0.21) |
| Ex.1.2 | PESA(40) PESB(60) | 800P(2) TS200(2) | Mogul L(8) | Formula (I) (2) | R972(0.21) NAX50 (0.21) |
| Ex.1.3 | PESA(40) PESB(60) | 800P(2) TS200(2) | Mogul L(8) | Formula (I) (2) | R972(0.21) NAX50 (0.21) |
| Ex.1.4 | PESC(100) | TS200(3) | Raven1255 (6) | S-34(2) | TS500(0.8) |
| Ex.1.5 | PESC(100) | TS200(3) | Raven1255 (6) | S-34(2) | R972(0.21) NAX50 (0.21) |
| Ex.1.6 | PESD(100) | TS200(3) | Mogul L(8) | E-84(2) | R972(0.21) NAX50 (0.21) |
| Com. Ex.1.1 | PESC(100) | TS200(3) | Raven1255 (6) | S-34(2) | TS500(0.8) |
| Com. Ex.1.2 | PESA(40) PESB(60) | 800P(2) TS200(2) | Mogul L(8) | Formula (I) (2) | R972(0.21) NAX50 (0.21) |
| Com. Ex.1.3 | PESD(100) | TS200(3) | Mogul L(8) | E-84(2) | TS500(0.8) |
| Com. Ex.1.4 | PESD(100) | TS200(3) | Mogul L(8) | E-84(2) | TS500(0.5) |

The meanings of the abbreviations shown in Table 1 are as belows.

With respect to the binder resins, PESA means the polyester resin A, PESB means the polyester resin B, PESC means the polyester resin C, and PESD means the polyester resin D.

With respect to the waxes, 800P means polyethylene wax (800P; made by Mitsui Sekiyu Kagaku Kogyo K.K.), and TS200 means polypropylene wax (TS-200; made by Sanyo Kasei Kogyo K.K.).

With respect to the colorants, Mogul L means acid carbon black (Mogul L; made by Cabot K.K.), and Raven1255 means carbon black (Raven1255; made by Colombian Carbon K.K.).

With respect to the charge-control agents, Formula (I) means negative charge-control agent represented by the abovementioned formula (I), S-34 means negative charge-control agent (S-34; made by Orient Kagaku Kogyo K.K.) and E-84 means zinc complex of salicylic acid (made by Orient Kagaku Kogyo K.K.).

With respect to the inorganic fine particles, R972 means hydrophobic silica (R972; made by Nippon Aerosil K.K), NAX50 means hydrophobic silica (NAX50; made by Nippon Aerosil K.K), TS500 means hydrophobic silica (TS-500; made by Cabot K.K), and STT30A means titanium oxide (STT-30A; made by Titan Kogyo K.K.).

The repose angle of the obtained toners was measured by means of powder tester (manufactured by Hosokawa Micron K.K.).

The mean roundness of the toners was measured by means of the flow-type particle image analyzer (FPIA-2000; manufactured by Toa Iyou Denshi K.K.).

The mean particle size of the toners was measured by means of Coulter counter MULTISIZER (made by Coulter K.K.).

Furthermore, the occurring state of the clogging and image qualities of the obtained toners were evaluated according to the following methods.

(Clogging)

Each toner was loaded in a printing apparatus having the construction as shown in FIG. 2, and a black solid image was repeatedly printed. The occurring state of the clogging of the holes when the printing was carried out by using A-4 size papers in a lengthwise state was evaluated according to the following method. Detailedly speaking, the fifth to the ninth holes from the right when they were observed from the side of an intermediate roller in a printing area of a printing head were photographed (175 magnifications) from the side of the intermediate roller, and it was estimated that when one or more of the holes that were clogged by the toner at a percentage of not less than 80% was observed, the clogging was ocurred.

◎; No clogging was occurred after 1000 sheets of papers were printed.

○; The clogging was occurred after 500–999 sheets of papers were printed.

Δ; The clogging was occurred after 100–499 sheets of papers were printed.

X; The clogging was occurred after not more than 99 sheets of papers were printed.

The setting conditions of the printing apparatus used are as follows (With respect to the abbreviations, see FIG. 2, FIG. 3 and FIG. 5).

Mechanical setting: Lk; 70 $\mu$m, Li; 200 $\mu$m

Electric setting: $V_B$; +450 V, $V_W$; −70 V, Vbe; 1000 V, Vb; −100 V, Vs; 0 V, Vb1; −100 V Adhesion amount of the toner on the intermediate roller: about 0.8 mg/cm$^2$ Velocity of each roller: peripheral velocity of the sleeve; 79.8 mm/s, peripheral velocity of the intermediate roller; 202.6 mm/s, peripheral velocity of the back roller; 104.2 mm/s Used FPC; (4 rows, 300 dpi) (thickness 110 $\mu$m, diameter of hole 140 $\mu$m) (The third row from the upper stream of four rows was used.)

A blade pressure of a regulating blade was adjusted so that an electrification amount of the toner (Q/M) would be 18 $\mu$C/g.

(Image qualities)

Each toner was loaded in a printing apparatus having the construction as shown in FIG. 2, and a printing pattern consisting of a part of dots, a part of lines, and a part of solid image was repeatedly printed. A trailing, a scattering between the lines, an image density and a sharpness of the image on the tenth printed sheet were visually observed by using a loupe (30 magnifications), and a synthetical evaluation of the toner was carried out according to the following criteria. Toner was evaluated by changing the electrification amount (Q/M). When the toner got four or more evaluation results which belong to "Δ", "○" and "◎", said toner was estimated at a toner for toner-jetting having a broad tolerance range for setting conditions of the apparatus. A measuring method of the electrification amount of the toner will be described later. The setting conditions of the printing apparatus were same as those employed in the abovementioned clogging-evaluation of the toner except for changing a blade pressure of the regulating blade within the range of from 2 to 14 g/mm in order to control the electrification amount of the toner (Q/M).

Image qualities were graded on the sum of the marks obtained in the evaluations of the following items 1–4.

◎; The sum was 8 marks.

○; The sum was 6–7 marks, and marks obtained in all items were 1 or more.

Δ; The sum was 4–5 marks, and marks obtained in all items were 1 or more.

X; There was 0 mark in any of the items.

Item 1; trailing

The dots on the printed image were observed. When no trailing (deforming) occurred, the toner obtained 2 marks. In the case where the printed dots could hardly be distinguished from the normal dots and brought about no problem in practical use, although the trailing (deforming) occurred, the toner obtained 1 mark. In the case where the trailing (deforming) occurred, and the printed dots could clearly be distinguished from the normal dots and brought about problem in practical use, the toner obtained 0 mark. The trailing means a phenomenon in which the dots are spread toward the moving direction of the paper and deformed.

Item 2; scattering between the lines

The line part on the printed image was observed. When no scattering of the toner occurred between the lines, on the texture region of the paper, the toner obtained 2 marks. In the case where although the scattering of the toner occurred here and there, said scattering brought about no problem in practical use, the toner obtained 1 mark. In the case where the scattering of the toner occurred in the whole region between the lines and brought about problem in practical use, the toner obtained 0 mark. The scattering between the lines means a phenomenon in which the toner particles are scattered between the lines on the texture region of the paper by an impact force and a mutual repulsion force of the toner particles when they are jettingly adhered to the surface of the paper. The width of a line in the line part of the printing pattern was about 90 $\mu$m and a width of the texture region of the paper between the lines was about 160 $\mu$m.

Item 3; image density

Image densities on optical five points of the solid image part were measured by using Macbeth Densitometer (made by Macbeth K.K.) and evaluated on the basis of their average value.

The toner showing the average value of not less than 1.4 obtained 2 marks.

The toner showing the average value of from not less than 1.3 to less than 1.4 obtained 1 mark.

The toner showing the average value of less than 1.3 obtained 0 mark.

Item 4; sharpness

The dot part, the line part and the solid image part on the printed image were observed. When a boundary between a toner region and the texture region of the paper could clearly be recognized, the toner obtained 2 marks. In the case where the boundary could be recognized and brought about no problem in practical use, the toner obtained 1 mark. In the case where the boundary could not recognized and was broad, said boundary bringing about the problem in practical use, the toner obtained 0 mark.

The abovementioned measurement results and evaluation results were summarized in the following Table 2. Here, with respect to the evaluation results "Δ" and "X" for the image qualities, the which were main causes for said evaluation results items were also shown (This indication manner was applied to the aftermentioned tables showing the same evaluation results).

TABLE 2

| | A toner mean particle size (μm) | A repose angle (*) | A content of particles having a particle size of not less than 9μm (% by weight) | A mean round-ness | Clog-ging | Q/M (controlled by changing a blade pressure within the range of 2–14 g/mm) | | | | | | | | |
|---|---|---|---|---|---|---|---|---|---|---|---|---|---|---|
| | | | | | | 6 μC/g (±1) | 10 μC/g (±1) | 18 μC/g (±1) | 25 μC/g (±1) | 31 μC/g (±1) | 35 μC/g (±1) | 40 μC/g (±1) | 45 μC/g (±1) | 51 μC/g (±1) |
| Com. Ex. 1.1 | 8.0 | 37.6 | 30.0 | 0.949 | × | × | ○ | △ | × | × | × | × | × | × |
| Com. Ex. 1.2 | 7.8 | 35.0 | 26.0 | 0.945 | △ | × | ○ | △ | × | × | × | × | × | × |
| Ex. 1.1 | 7.5 | 33.0 | 22.0 | 0.945 | ○ | × | ○ | ○ | ○ | △ | × | × | × | × |
| Ex. 1.2 | 7.9 | 29.0 | 28.0 | 0.961 | ◎ | × | ○ | ◎ | ◎ | ◎ | ○ | ○ | △ | × |
| Ex. 1.3 | 7.7 | 20.0 | 26.0 | 0.964 | ◎ | × | ○ | ◎ | ◎ | ◎ | ◎ | ○ | ○ | × |
| Ex. 1.4 | 7.6 | 11.0 | 24.0 | 0.971 | ◎ | × | ○ | ◎ | ◎ | ◎ | ○ | ○ | ○ | × |
| Ex. 1.5 | 7.7 | 10.0 | 25.0 | 0.981 | ○ | × | ○ | ◎ | ◎ | ○ | ○ | △ | × | × |
| Ex. 1.6 | 7.9 | 9.0 | 28.0 | 0.992 | △ | × | ○ | ○ | ○ | ○ | ○ | △ | × | × |
| Com. Ex. 1.3 | 7.9 | 7.0 | 28.0 | 0.992 | × | × | × | △ | ○ | ○ | △ | × | × | × |
| Com. Ex. 1.4 | 7.7 | 20.0 | 25.0 | 0.995 | × | × | △ | ○ | ○ | ○ | × | × | × | × |

Reduction of density

Occurences of a trailing and a scattering

Reduction of a density

Occurences of a scattering and reduction of sharpness

Method for measuring the electrification amount

The electrification amount of the toner according to the present invention, was measured according to the following method. Toner layers formed on the toner-supplying roller 30 and the intermediate roller 100 by a normal image-formation method was sucked by a suction tube equipped with a filter layer on the side of an exit, and a change of an electrification amount of the toner-supplying roller 30 or the intermediate roller 100 at the time of sucking the toner layers was measured by a Digital Electrometer TR8652 (made by Advantest K.K.). The electrification amount of the toner per unit weight was calculated from the weight of the sucked toner.

Experimental Example 2

Examples 2.1–2.6 and Comparative Examples 2.1–2.2

Toners were obtained by carrying out the same method as described in example 1.1 except that the given amounts of the binder resins, the waxes, the colorants, the charge-control agents and the inorganic fine particles which were added after the surface treatment shown in Table 3 were used, and the grinding conditions (including the kind of the grinder and the like) were appropriately changed, and the particles having a large particle size were removed by using a DS classifier (made by Nippon Pneumatic Kogyo K.K.) prior to an addition of the inorganic fine particles.

In the examples 2.5–2.7 and the comparative examples 2.3 and 2.4, the colorant was used as a pigment masterbatch with the binder resin to be used. The pigment masterbatch was prepared by melt-mixing a part (7 parts by weight) of the binder resin (100 parts by weight) and 3 parts by weight of the colorant, and cooling the melt-mixture, and then grinding the cooled mixture. In other words, 93 parts by weight of the binder resin, 10 parts by weight of the pigment masterbatch and the given amounts of the wax and the charge-control agent were employed during the preparation processes of the toners in these examples and comparative examples. The preparation conditions of the toners are summarized in the following Table 3.

TABLE 3

| | Binder resin (parts by weight) | Wax (parts by weight) | Colorent (parts by weight) | Charge-control agent (parts by weight) | Inorganic fine particles added after the surface treatment (% by weight) |
|---|---|---|---|---|---|
| Ex.2.1 | PESA(40) PESB(60) | 800P(2) TS200(2) | Mogul L(8) | Formula (I) (2) | TS500(0.5) STT30A (1.0) |
| Ex.2.2 | PESA(40) PESB(60) | 800P(2) TS200(2) | Mogul L(8) | Formula (I) (2) | R974(0.3) SW100 (0.5) |
| Ex.2.3 | PESA(40) PESB(60) | 800P(2) TS200(2) | Mogul L(8) | Formula (I) (2) | TS500 (0.5) STT30A (1.0) |
| Ex.2.4 | PESC(100) | TS200(3) | Raven1255 (6) | S-34(2) | TS500(0.5) STT30A (1.0) |

TABLE 3-continued

| | Binder resin (parts by weight) | Wax (parts by weight) | Colorent (parts by weight) | Charge-control agent (parts by weight) | Inorganic fine particles added after the surface treatment (% by weight) |
|---|---|---|---|---|---|
| *Ex.2.5 | PESD(100) | — | C.I.184(3) | E-84(2) | TS500(0.8) |
| *Ex.2.6 | PESD(100) | — | C.I.184(3) | E-84(2) | TS500(0.8) |
| *Ex.2.7 | PESD(100) | — | C.I.184(3) | E-84(2) | TS500(0.9) |
| Com. Ex.2.1 | PESC(100) | TS200(3) | Raven1255 (6) | S-34(2) | TS500(1.0) |
| Com. Ex.2.2 | PESA(40) PESB(60) | 800P(2) TS200(2) | Mogul L(8) | Formula (I) (2) | R972(0.3) NAX50 (0.3) |
| *Com. Ex.2.3 | PESD(100) | — | C.I.184(3) | E-84(2) | TS500(1.0) |
| *Com. Ex.2.4 | PESD(100) | — | C.I.184(3) | E-84(2) | TS500(0.8) |

*The colorant was used as a pigment masterbatch with the binder resin in examples 2.5–2.7 and comparative examples 2.3 and 2.4.

The meanings of the abbreviations appeared in Table 3 are as follows (the same abbreviations as those used in Table 1 have the same meanings, so that their explanations were omitted).

The colorant C.I. 184 means the magenta pigment (C.I. pigment red 184).

The inorganic fine particles SW100 and R974 mean the hydrophobic acid titanium (supplied by Titan Kogyo K.K.) and the hydrophobic silica (supplied by Nippon Aerosil K.K.) respectively.

The measurements of the repose angle and the mean roundness of the toners and the content of the toner whose particle size is 9 $\mu$m or more (% by weight) as well as the evaluations of the clogging and image quality were carried out by the same manners as those described in the experimental example 1.

The abovementioned measurement results and evaluation results were summarized in the following Table 4.

TABLE 4

| | A toner mean particle size (μm) | A repose angle (*) | A content of particles having a particle size of not less than 9μm (% by weight) | A mean round-ness | Clog-ging | Q/M (controlled by changing a blade pressure within the range of 2–14 g/mm) | | | | | | | | |
|---|---|---|---|---|---|---|---|---|---|---|---|---|---|---|
| | | | | | | 6 μC/g (±1) | 10 μC/g (±1) | 18 μC/g (±1) | 25 μC/g (±1) | 31 μC/g (±1) | 35 μC/g (±1) | 40 μC/g (±1) | 45 μC/g (±1) | 51 μC/g (±1) |
| Com. Ex. 2.1 | 6.7 | 37.6 | 7.0 | 0.949 | × | × | ○ | △ | × | × | × | × | × | × |
| Com. Ex. 2.2 | 6.5 | 35.0 | 6.0 | 0.945 | △ | × | ○ | △ | × | × | × | × | × | × |
| Ex. 2.1 | 6.6 | 29.1 | 6.3 | 0.945 | ○ | × | ○ | ◎ | ◎ | ○ | △ | × | × | × |
| Ex. 2.2 | 6.8 | 25.0 | 7.4 | 0.961 | ◎ | × | ○ | ◎ | ◎ | ○ | ○ | ○ | △ | × |
| Ex. 2.3 | 7.0 | 17.5 | 8.2 | 0.964 | ◎ | × | ○ | ◎ | ◎ | ◎ | ◎ | ○ | ○ | △ |
| Ex. 2.4 | 7.3 | 10.5 | 9.9 | 0.971 | ◎ | × | ○ | ◎ | ◎ | ◎ | ◎ | ○ | ○ | △ |
| Ex. 2.5 | 7.6 | 9.5 | 18.6 | 0.981 | ○ | × | ○ | ○ | ◎ | ○ | ○ | ○ | × | × |
| Ex. 2.6 | 7.3 | 7.0 | 10.0 | 0.992 | ○ | × | ○ | ◎ | ○ | ○ | ○ | △ | × | × |
| Ex. 2.7 | 7.4 | 3.8 | 12.0 | 0.992 | △ | × | ○ | ○ | ○ | ○ | ○ | △ | × | × |
| Com. Ex. 2.3 | 7.3 | 2.0 | 10.0 | 0.992 | △ | × | ○ | ○ | △ | × | × | × | × | × |
| Com. Ex. 2.4 | 8.2 | 4.0 | 24.2 | 0.995 | △ | × | ○ | ○ | △ | × | × | × | × | × |

Reduction of a density occurences of a trailing and a scattering

Occurences of a scattering and reduction of sharpness

As described above in detail, the toner according to the present invention brings about an excellent effect that said toner increases an image quality without causing no clogging even if an electrification amount is relatively high. In other words, the toner according to the present invention provides an image having an excellent sharpners without causing the occurrences of a trailing, a scattering and a reduction of an image density. Furthermore, the tolerance range of setting conditions of the printing apparatus can be broadened by employing the toner according to the present invention.

What is claimed is:

1. A toner comprising:

a binder resin and a colorant;

the toner having a repose angle of 8.0–34.0° and a mean roundness of 0.945–0.992, and the toner used in an image forming apparatus using a toner-jetting system.

2. A toner of claim 1, wherein the repose angle is 10.0–33.0°.

3. A toner of claim 1, wherein the repose angle is 11.0–29.0°.

4. A toner of claim 1, wherein the mean roundness is 0.961–0.981°.

5. A toner of claim 1, wherein the mean roundness is 0.964–0.971°.

6. A toner of claim 1, wherein the repose angle is 10.0–33.0°, and the mean roundness is 0.961–0.981.

7. A toner of claim 1, wherein the repose angle is 11.0–29.0°, and the mean roundness is 0.964–0.971.

8. A toner of claim 1, wherein the image-forming apparatus comprises (i) a toner-supporting member for supporting the toner, (ii) a back electrode which is arranged on the opposite side of the toner-supporting member at a predetermined interval, (iii) a partition wall equipped with plural penetration holes for passing the toner and a recording electrode which is arranged in the neighborhood of each of the penetration holes, said partition wall being arranged between the toner-supporting member and the back electrode, and (iv) a driver which applies a voltage to the recording electrode in response to an image signal.

9. A toner comprising:

a binder resin and a colorant;

the toner having a repose angle of 3.0–34.0° and a mean roundness of 0.945–0.992, and the toner used in an image forming apparatus using a toner-jetting system, wherein a content of toner whose particle size is 9 $\mu$m or more is 23% by weight or less.

10. A toner of claim 9, wherein the repose angle is 7.0–30.0°.

11. A toner of claim 9, wherein the repose angle is 10.0–26.0°.

12. A toner of claim 9, wherein the mean roundness is 0.961–0.981.

13. A toner of claim 9, wherein the mean roundness is 0.964–0.971.

14. A toner of claim 9, wherein the content is 20% by weight or less.

15. A toner of claim 9, wherein the content is 15% by weight or less.

16. A toner of claim 9, wherein the content is 10% by weight or less.

17. A toner of claim 9, wherein the repose angle is 7.0–30.0°, the mean roundness is 0.961–0.981, and the content is 20% by weight or less.

18. A toner of claim 9, wherein the repose angle is 10.0–26.0°, the mean roundness is 0.964–0.971, and the content is 15% by weight or less.

19. A toner of claim 9, wherein the repose angle is 10.0–26.0°, the mean roundness is 0.964–0.971, and the content is 10% by weight or less.

20. A toner of claim 9, wherein the image-forming apparatus comprises (i) a toner-supporting member for supporting the toner, (ii) a back electrode which is arranged on the opposite side of the toner-supporting member at a predetermined interval, (iii) a partition wall equipped with plural penetration holes for passing the toner and a recording electrode which is arranged in the neighborhood of each of the penetration holes, said partition wall being arranged between the toner-supporting member and the back electrode, and (iv) a driver which applies a voltage to the recording electrode in response to an image signal.

* * * * *